US007236737B2

(12) United States Patent
Mochizuki

(10) Patent No.: US 7,236,737 B2
(45) Date of Patent: Jun. 26, 2007

(54) SHEET POST-PROCESSING APPARATUS AND IMAGE FORMING APPARATUS

(75) Inventor: Naoto Mochizuki, Fuefuki (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 310 days.

(21) Appl. No.: 11/017,007

(22) Filed: Dec. 21, 2004

(65) Prior Publication Data

US 2005/0152725 A1 Jul. 14, 2005

(30) Foreign Application Priority Data

Dec. 25, 2003 (JP) ..... 2003-429547

(51) Int. Cl.
*G03G 15/00* (2006.01)

(52) U.S. Cl. ..... 399/410; 399/407

(58) Field of Classification Search ..... None
See application file for complete search history.

(56) References Cited

FOREIGN PATENT DOCUMENTS

JP 10059612 A * 3/1998
JP 2005170625 A * 6/2005

* cited by examiner

*Primary Examiner*—Daniel J. Colilla
*Assistant Examiner*—N. Ha
(74) *Attorney, Agent, or Firm*—Manabu Kanesaka

(57) ABSTRACT

A sheet post-processing apparatus includes a loading section for loading a sheet, and a punching device for punching the sheet loaded in the loading section at a punching position. A sheet bundle forming device is provided for forming a sheet bundle of the sheet punched by the punching device and a sheet not punched by the punching device. A binding device drives a staple into the sheet bundle at the punching position as a bound position to bind the sheet bundle.

9 Claims, 8 Drawing Sheets

SHEET POST-PROCESSING APPARATUS AND IMAGE FORMING APPARATUS

BACKGROUND OF THE INVENTION AND RELATED ART STATEMENT

The present invention relates to a sheet post-processing apparatus and an image forming apparatus, and in particular, to a sheet post-processing apparatus and an image forming apparatus for forming and binding a bundle of sheets with images.

A sheet post-processing apparatus has been known for aligning ends of a plurality of sheets and forming the sheets into a bundle. The sheets are discharged from an image forming apparatus such as a printer or a facsimile machine after images are printed on the sheets. The sheet post-processing apparatus uses a stapler to staple and bind the sheet bundle (see, for example, Patent Document 1). Such a sheet post-processing apparatus discharges a bundle of sheets with the ends thereof aligned with one another after being bound. Consequently, the finished sheet bundle appears neat, and it is not necessary to manually align and bind the sheets discharged by the image forming apparatus.

Such a sheet post-processing apparatus comprises a stapler unit for stapling a sheet bundle. The stapler unit generally has a minimum number of sheets that can be bound, for example, 20 or 30 sheets. A print grade (cost) and power consumption depend on the number of sheets that can be bound using the stapler unit. In a binding apparatus, leg portions of a bind member such as a staple are penetrated into the sheet bundle at punched positions (for example, refer to Patent Documents 2 and 3).

Patent Document 1: Japanese Patent Publication (Kokai) No. 2003-267622

Patent Document 2: Japanese Patent Publication (Kokai) No. 11-20363

Patent Document 3: Japanese Patent Publication (Kokai) No. 11-20364

In the conventional sheet post-processing apparatus, it is necessary to increase a load on a staple penetrating a sheet bundle when a large number of sheets are bound. Accordingly, when the sheet bundle has a large thickness, leg portions (tip portions) of a staple may not withstand the load and may be bent, thereby causing inappropriate binding. Further, for example, color print sheets have coated surfaces and a thickness larger than normal (monochrome) sheets. Accordingly, for a certain type of sheets, the load on the staple becomes greater, thereby causing a problem similar to that associated with a large number of sheets.

To solve the problems, it is possible to increase the strength of the staple. However, in this case, a driving force greater the load is required to drive the staple into the sheet bundle. Consequently, the stapler unit and the sheet post-processing apparatus must have a large size. Noise or vibration also increases when the staple is penetrated into the sheet bundle, and power consumption increases. When a bundle of sheets is bound with a strong staple, it is difficult to remove the staple, thereby making it difficult to handle the sheet post-processing apparatus.

In view of the problems described above, an object of the present invention is to provide a sheet post-processing apparatus and an image forming apparatus capable of reliably binding a sheet bundle without increasing a size of the apparatus. It is also possible to reduce noise, vibration, and power consumption even if a large number of sheets or thick sheets are processed.

Further objects and advantages of the invention will be apparent from the following description of the invention.

SUMMARY OF THE INVENTION

To accomplish the objects described above, according to a first aspect of the present invention, a sheet post-processing apparatus comprises a loading section in which sheets are loaded; a punching device for selectively punching the sheets loaded in the loading section; a sheet bundle forming device for mixing sheets punched by the punching device with sheets not punched by the punching device to form a sheet bundle; and a binding device for using staples to bind the sheet bundle at punched positions on the sheets punched by the punching device as bound positions. The sheets are included in the sheet bundle formed by the sheet bundle forming device.

In the first aspect, the sheet post-processing apparatus comprises the loading section in which the sheets are loaded. The punching device selectively punches the sheets loaded in the loading section. The sheet bundle forming device mixes the sheets punched by the punching device with the sheets not punched by the punching device to form the sheet bundle. The binding device uses the staples to bind the sheet bundle at the punched positions on the sheets punched by the punching device as the bound positions. The sheets are included in the sheet bundle formed by the sheet bundle forming device.

In the first aspect of the present invention, the binding device uses the staples to bind the sheet bundle at the punched positions on the sheets punched by the punching device as the bound positions. Thus, the binding device does not need to drive the staples all the sheets constituting the sheet bundle. Consequently, the binding device can bind the sheet bundle without increasing a size of the apparatus, noise, vibration, or power consumption. Further, the sheets not subjected to the punching process are stapled to fix positions of the staples. Therefore, leg portions of the staples can be appropriately bent, thereby properly binding the sheet bundle.

In the first aspect, the punching device may avoid punching the sheet bundle at the bound position on at least the last sheet penetrated by the leg portions of the staples driven by the binding device into the sheet bundle. The last sheet is included in the sheets constituting the sheet bundle formed by the sheet bundle forming device. After the binding process, the staples move within the punching positions of the sheets of the sheet bundle to prevent the sheets from coming off sequentially or all together from between the bent leg portions of the staples and then loosening.

Alternatively, the punching device may avoid punching the sheet bundle at the bound position on at least the first sheet penetrated by the leg portions of the staples driven by the binding device into the sheet bundle. The first sheet is included in the sheets constituting the sheet bundle formed by the sheet bundle forming device. When the first sheet penetrated by the leg portions of the staples becomes a front surface of the sheet bundle, a punching mark on the sheets is hidden, making the sheet bundle look good.

According to a second aspect of the present invention, an image forming apparatus comprises an image forming device for forming images on sheets; a conveying device for conveying the sheets with the images formed by the image forming device; a punching device for punching the sheets conveyed by the conveying device; a punching process determining device for determining whether the punching device punches the sheets with the images formed by the image forming device; a sheet bundle forming device for mixing sheets punched by the punching device with sheets not punched by the punching device to form a sheet bundle; and a binding device for using staples to bind the sheet bundle at the punched positions on the sheets punched by the punching device as bound positions. The sheets are included in the sheet bundle formed by the sheet bundle forming device.

In the second aspect, the image forming device forms the images on the sheets. The conveying device conveys the sheets with the images formed by the image forming device. The punching device punches the sheets conveyed by the conveying device. The sheet bundle forming device mixes the sheets punched by the punching device with the sheets not punched by the punching device to form the sheet bundle. The binding device uses staples to bind the sheet bundle at the punched positions on the sheets punched by the punching device as the bound positions. The sheets are included in the sheet bundle formed by the sheet bundle forming device. The punching process determining device determines whether the punching device punches the sheets with the images formed by the image forming device. The punching process determining device may determine before the image forming device starts the image formation or after the image forming device finishes the image formation (before the punching process).

In the second aspect, the punching process determining device preferably determines to avoid punching the sheet bundle at the bound positions on at least the last and/or first sheet penetrated by the leg portions of the staples driven by the binding device into the sheet bundle. The first sheet is included in the sheets constituting the sheet bundle formed by the sheet bundle forming device.

Further, in the second aspect, the apparatus may further comprise a binding process specifying device for specifying a binding process executed by the binding device and a sheet number setting device for setting the number of sheets on which images are to be formed. When the binding process specifying device specifies the binding process, the punching process determining device determines whether the punching device punches the sheets with the images formed by the image forming device in accordance with the number of sheets set by the sheet number setting device.

In this case, when the number of sheets set by the sheet number setting device exceeds a preset number of sheets bound by the binding device, the punching process determining device determines whether the punching device punches the sheets with the images formed by the image forming device. Accordingly, even when the preset number of sheets bound by the binding device is exceeded, the sheet bundle can be reliably automatically bound.

The apparatus may further comprise a selecting device for allowing an operator to choose whether the punching device punches the sheets with the images formed by the image forming device. When the number of sheets set by the sheet number setting device exceeds the preset number of sheets bound by the binding device, the punching process determining device may determine whether the punching device executes a punching process in accordance with the selection made by the operator using the selecting device.

In the second aspect, the apparatus may further comprises a binding process specifying device for specifying a binding process executed by the binding device and a type specifying device for setting a type of sheets on which images are to be formed. When the binding process specifying device specifies a binding process, the punching process determining device determines whether the punching device punches the sheets with the images formed by the image forming device in accordance with the type of sheets set by the type specifying device.

In this case, when the type of sheets set by the type specifying device is color print sheets, the punching process determining device determines whether the punching device punches the sheets with the images formed by the image forming device. Accordingly, even with thick color print sheets that impose a heavy burden on a binding process, the sheet bundle can be reliably automatically bound. The apparatus may further comprise a selecting device for allowing the operator to choose whether the punching device punches the sheets with the images formed by the image forming device, so that the operator can choose the process. When the type of sheets set by the type specifying device is color print sheets, the punching device executes a punching process in accordance with the selection made by the operator using the selecting device.

According to the present invention, the binding device uses staples to bind the sheet bundle at the punched positions on the sheets punched by the punching device as the bound positions. The sheets are included in the sheet bundle formed by the sheet bundle forming device. Accordingly, the binding device does not need to drive the staples all the sheets constituting the sheet bundle. This allows the binding device to bind the sheet bundle without increasing a size of the apparatus, noise, vibration, or power consumption. Further, the sheets not subjected to the punching process are stapled to fix the positions of the staples. Therefore, the leg portions of the staples can be appropriately bent, and the sheet bundle is reliably bound.

DETAILED DESCRIPTION OF PREFERRED EMBODIMENTS

Hereunder, embodiments of the present invention will be described with reference to the accompanying drawings.

(Configuration)

Figure 1:
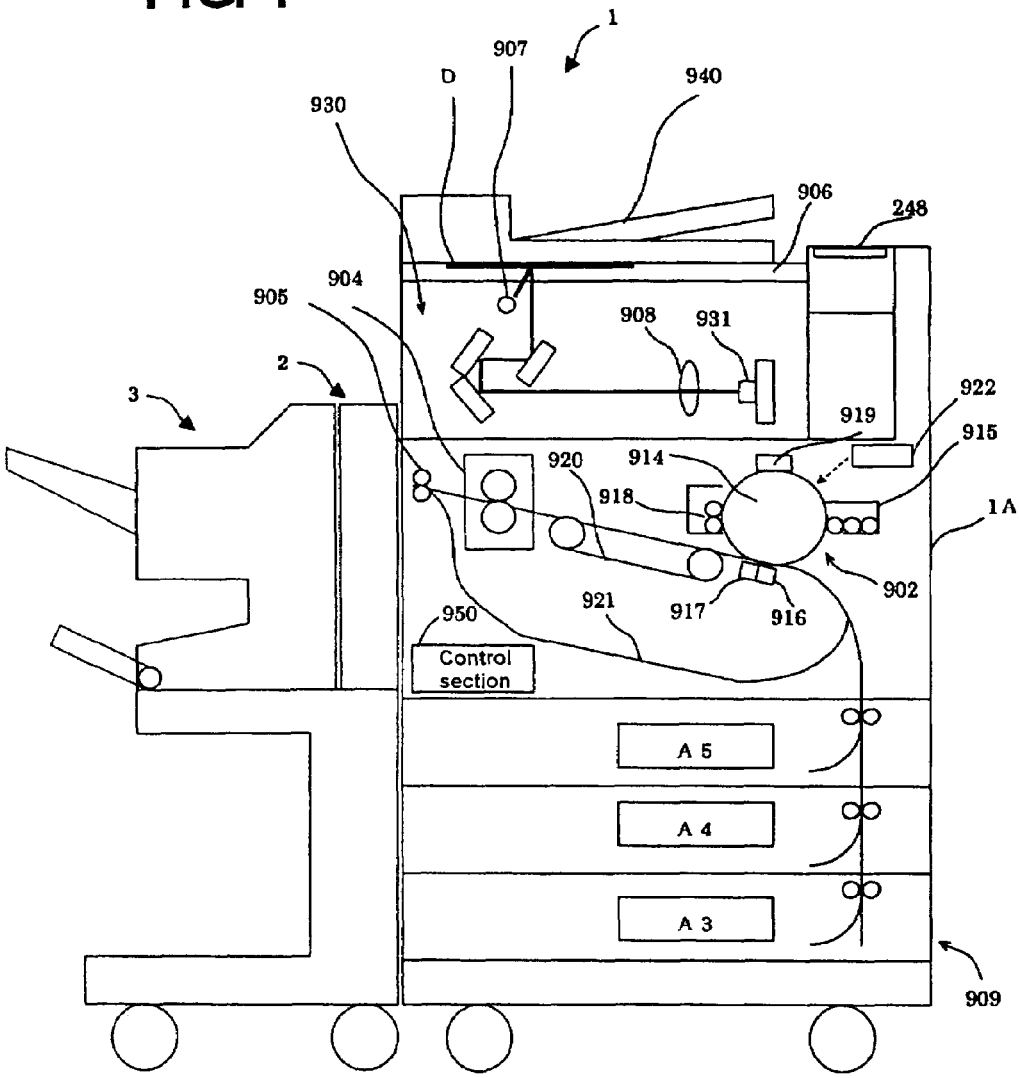
FIG. 1 is a side sectional view of a digital copier according to an embodiment of the present invention.

As shown in FIG. 1, according to an embodiment, a digital copier 1 comprises a digital copier main body 1A that forms images on sheets, a sheet punching apparatus 2 installed on a side of the digital copier main body 1A to punch the sheets with the images conveyed by the digital copier main body 1A, and a sheet post-processing apparatus 3 installed on a downstream side of the sheet punching apparatus 2 to execute a binding process or the like on a sheet bundle composed of the plurality of sheets. In the present embodiment, the sheet punching apparatus 2 is one of option apparatus of the sheet post-processing apparatus 3. In the present invention, the sheet punching apparatus 2 functions as a part of a sheet post-processing apparatus.

<Digital Copier Main Body>

The digital copier main body 1A has an image forming section 902 as an image forming device for recording a copied image from a document D on a sheet, an image input section 200 disposed above the image forming section 902 and having a light source 907 that irradiates the document D, the image input section 200 for forming reflected light from the document D on a CCD 201 via an optical system 908 and functioning as a scanner, a sheet feeding section 909 placed below the image forming section 902 to feed sheets to the image forming section 902 one by one, and a control section 950 for controlling operations of the above sections as a punching process determining device.

The sheet feeding section 909 can be freely installed in and removed from the digital copier main body 1A. The sheet feeding section 909 has a cassette 910 in which A5-sized sheets are accommodated, a cassette 911 in which A4-sized sheets are accommodated, and a cassette 913 in which A3-sized sheets are accommodated.

The image forming section 902 has a cylindrical photosensitive drum 914 having an outer peripheral surface for forming a latent image. The following components are disposed around a periphery of the photosensitive drum 914: a primary charger 919 that provides charges to the photosensitive drum 914 for image formation; a laser unit 922 that outputs laser beams modulated in accordance with image data stored in a hard disk 961 (see FIG. 2) to a surface of the photosensitive drum 914; a developing member 915 that develops an electrostatic latent image formed on the photosensitive drum 914 to obtain a toner image; a transfer changer 916 that charges a sheet in order to transfer the toner image to the sheet; a separating charger 917 that separates the sheet from the photosensitive drum 914 by charging the sheet so that the sheet has a polarity opposite to that provided by the transfer charger 916; and a cleaner 918 that cleans the photosensitive drum 914.

A laser unit 922 has a semiconductor laser that generates laser beams; a polygon mirror that converts laser beams output by the semiconductor laser via a collimator lens into beams for respective lines; an fθ lens that converts the laser beams for the respective scan lines from the polygon mirror into parallel lights; a mirror that reflects the parallel lights from the fθ lens and guides them to the photosensitive drum; and a motor that rotates the polygon mirror.

A roller around which an endless conveying belt 920 is wound is placed at a downstream side of the photosensitive drum 914 and near the separating charger 917. The endless conveying belt 920 is extended between the above roller and a roller having a heat roller or the like and placed near a fixer 904 that heats and fixes a toner image to a sheet. A pair of discharge rollers 905 is disposed at a downstream side of the fixer 904; the discharge roller pair 905 operates as a conveying device for discharging a sheet with an image from the digital copier main body 1A and conveying the sheet. A duplex 921 is placed below the endless conveying bent 920 between the discharge roller pair 905 at an upstream side of the photosensitive drum 914 to carry out double side printing by forming an image on the other surface of a sheet with an image formed on one surface.

The following components are provided above the digital copier main body 1A: a platen glass 906 on which the document D is placed, and a touch panel which displays, for example, a status of the digital copier 1A in accordance with information from the control section 950 and is operated by an operator to provide an operational instruction to the control section 950. The touch panel operates as a binding process specifying device, sheet number setting device, type specifying device, and selecting device. An automatic document feeding apparatus (ADF) 940 is placed above the platen glass 906, wherein one side of the automatic document feeding apparatus 940 is fixed to a top portion of the digital copier main body 1A, and the other side rotationally movably covers the platen glass 906. The automatic document feeding apparatus 940 can automatically feed the document D to the platen glass 906.

Figure 2:
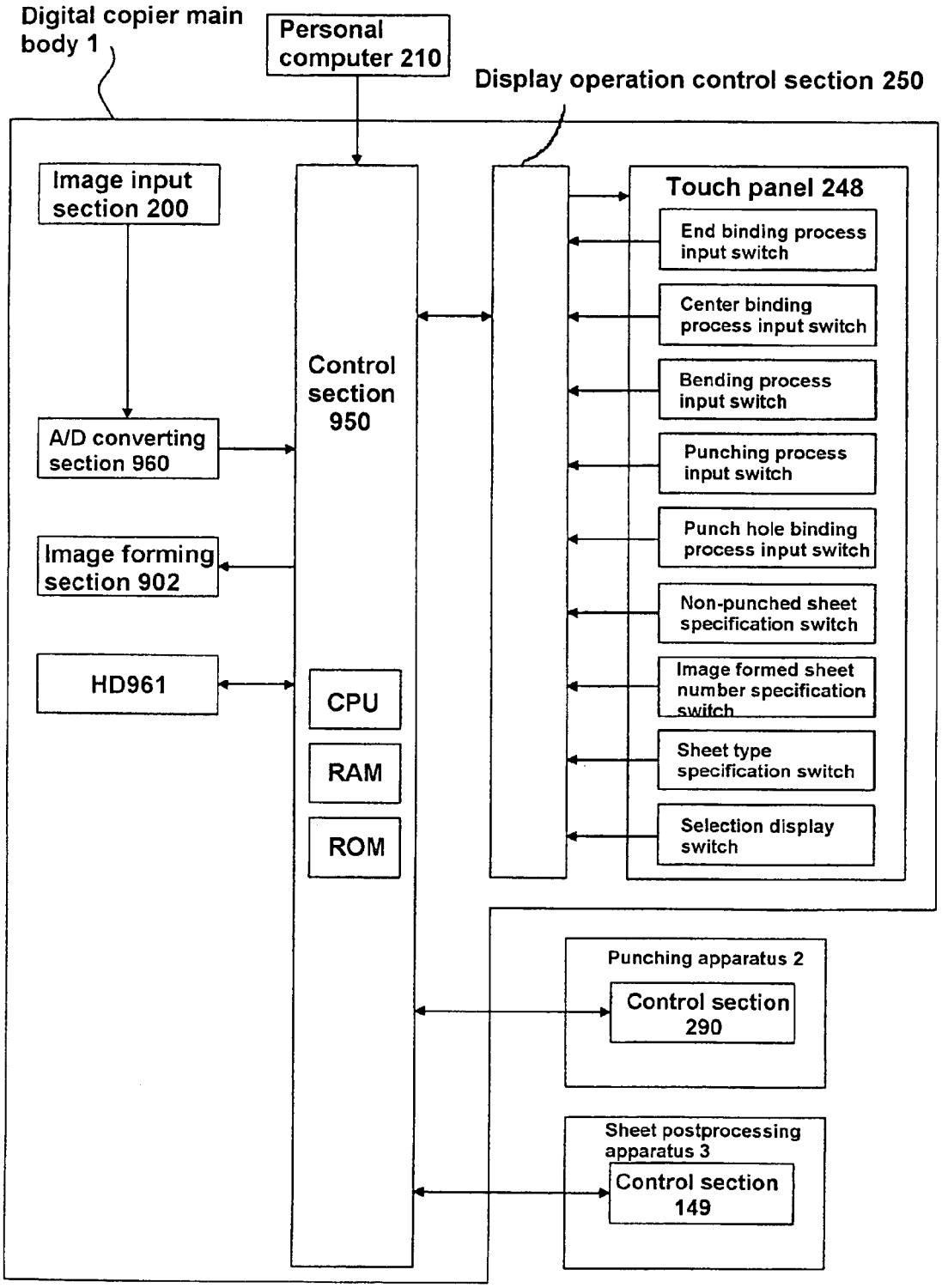
FIG. 2 is a block diagram schematically showing a configuration of a control section of a digital copier main body.

As shown in FIG. 2, the control section 950 is formed of a CPU operating as a central processing unit (hereinafter referred to as a CPU 1); a ROM that stores basic control programs for the digital copier 1A; a RAM that serves as a work area for the CPU 1; and an internal bus that connect the above components together. An external bus is connected to the control section 950. The external bus is connected via an interface (not shown) to a personal computer 210; an A/D converting section 950 that converts analog image data input by the image input section 200 into digital data; a hard disk (HD) 961 in which image data transmitted by the image forming section 902, the image input section 200, and the personal computer 210 is stored; a touch panel display operation control section 250 that controls a display on the touch panel 248 and operational instructions; and a control section 290 of the punching process apparatus 2 and a control section 149 of the sheet post-processing apparatus 3 (described later). The image input section 200 is connected to the A/D converting section 960. The touch panel display operation control section 250 is connected to the touch panel 248.

An initial screen of the touch panel 248 displays not only a sheet number specifying button and the like but also a selection display switch button that permits a selection made by the operator. When the selection display switch is pressed, the touch panel 248 displays a plurality of switch buttons including an end binding process input switch button used to execute an end binding process on a sheet bundle composed of a plurality of sheets; a saddle stitching process input switch button used to execute saddle stitching on the sheet bundle; a folding process input switch button used to fold the sheet bundle to form a book; a punching process input switch button used to form punch holes in sheets; a punch hole binding process input switch button used to bind a sheet bundle obtained by mixing punched sheets in which punch holes have been formed with non-punched sheets in which no punch holes have been formed; a non-punched sheet specifying switch button (selecting device) used to specify non-punched sheets for punch hole binding process;

an image formed sheet number specifying switch button used to specify the number of sheets constituting the sheet bundle and on which images are to be formed; a sheet type specifying switch button used to specify the type of sheets such as color print sheets. The end binding process includes two types: one-position binding and two-position binding, and can also be selected using the end binding process input switch button.

<Sheet Punching Apparatus>

Figure 3:
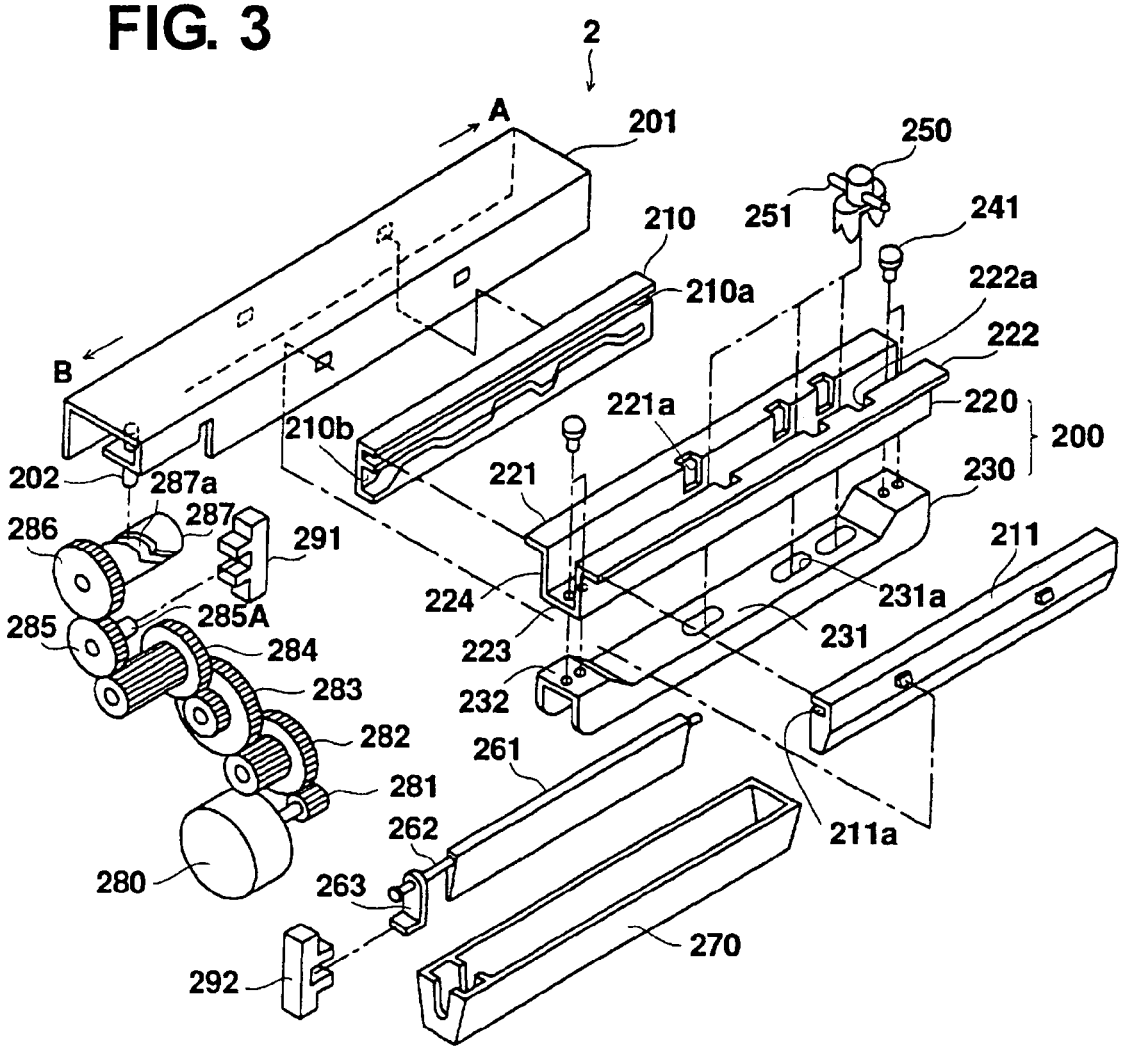
FIG. 3 is an exploded perspective view of a sheet punching apparatus.

As shown in FIG. 3, the sheet punching apparatus 2 has three punches 250 operating as a forked cylindrical punching device for punching sheets. Each of the punches 250 has a punching blade at a tip of a lower part of a cylinder. The punch 250 has an operating pin 251 penetrating the punch in a direction orthogonal to an axial direction of the punch. The punches 250 are accommodated in a punch guide 200 fixed to a sheet conveying path 245 (see FIG. 4) serving as a part of a loading section. The punch guide 200 is composed of an upper punch guide 220 and a lower punch guide 230.

The upper punch guide 220 is formed of a channel-like member. The upper punch guide 220 has flange portions 221 and 222 formed at ends of rising portions of the channel-like member and bent outwardly so that the upper punch guide 220 has a generally L-shaped cross section. Three pin penetrating windows 221*a* are formed in one of the rising portions 224 and the flange portion 221 by cutting out the rising portion and flange portion in rectangular form. Similar to the pin penetrating windows 221*a*, pin penetrating windows 222*a* are formed in the other rising portions 224 and flange portion 222 at positions corresponding to the pin penetrating windows 221*a*. Three through-holes (not shown) through which the punching blades of the punches 250 can advance are formed in the center of a channel bottom portion 223 of the upper punch guide 220 in association with the pin penetrating windows 221*a* and 222*a* formed in the rising portions 224.

The lower punch guide 230 is also formed of a channel-like member. The lower punch guide 230 has a central planar portion 231 and projecting planar portions 232 located at opposite ends of the punch guide and projecting upwardly. Three through-holes 231*a* through which the punching blades of the punches 250 can advance are formed in the central planar portion 231 in association with the positions of the through-holes formed in the channel bottom portion 223 of the upper punch guide 220.

The channel bottom portion 223 of the upper punch guide 220 and the projecting planar portion 232 of the lower punch guide 230 are tightly fastened at their opposite ends using screws 241. A space is formed between the channel bottom portion 223 of the upper punch guide 220 and the central planar portion 231 of the lower punch guide 230 as a part of the loading section through which sheets can be loaded and conveyed (referred to as a loading space).

The operating pins 251 of the punches 250 engage guide grooves 210*b* and 211*b* (see FIG. 5) formed in sliders 210 and 211 and passing through the pin penetrating windows 221*a* and 222*a*, respectively. The guide grooves 210*b* and 211*b* extend in a longitudinal direction of surfaces of the sliders 210 and 211 facing the pinch guide 220. The guide grooves 210*b* and 211*b* are formed by connecting together an upper horizontal groove portion, a lower horizontal groove portion, and inclined groove portions joining the upper horizontal groove portion and the lower horizontal groove portion together. Further, substantially horizontal slider grooves 210*a* and 211*a* are formed above the guide grooves 210*b* and 211*b* in the longitudinal direction of the sliders 210 and 211, respectively. Tips of the flange portions 221 and 222 engage the slider grooves 210*a* and 211*a*, respectively.

Each of the sliders 210 and 211 has two projections on a surface opposite to the surface where the slider groove 210*a* or 211*a* and the guide groove 210*b* or 211*b* are formed. The sliders 210 and 211 are fixed to a substantially channel-like slide holder 201 by fitting the projections into rectangular windows formed in a rising portion of the slide holder 201. An engaging pin 202 is secured to one side of the slide holder 201. A lower end of the engaging pin 202 engages a cam groove 287*a* formed in a shaft 287. One end of the shaft 287 is secured to a gear 286. The other end of the shaft 287 is rotatably supported by a support member (not shown).

A rotational driving force of a motor 280 is transmitted to the gear 286 via a gear 281 secured to a motor shaft of a stepping motor 280 that can rotate forward and backward; a gear 282 engaging the gear 281; and gears 283, 284, and 285. Accordingly, when the shaft 287 rotates forward or backward, the engaging pin 202 engaging the cam groove 287*a* slides the slide holder 201 in the direction of arrow A or B in FIG. 3. The slide holder 201 supports the sliders 210 and 211 in a direction orthogonal to a direction in which the punches 250 advance. An RP detection piece 285A is projected from the gear 285 engaging the gear 286 to detect a reference position for the cam groove 287*a*, i.e., a reference position (hereinafter referred to as an RP) for the guide grooves 210*b* and 211*b* formed in the sliders 210 and 211, respectively. A detection sensor 291 detects the RP detection piece 285A, that is the RP for the guide grooves 210*b* and 211*b*.

A receiving plate (not shown) is placed below the lower punch guide 230 to receive punch chips. A flapper 261 is placed on one side of the receiving plate and rotationally moved around a rotational movement shaft 262 under the rotating force of a motor (not shown) to sweep punch chips out of the receiving plate, so that the punch chips fall into a garbage can 270 placed below the receiving plate. A detection piece 263 is secured to the rotational movement shaft 262 to detect the reference position of the flapper 261. A detection sensor 292 detects the detection piece 263, that is, a reference position for the flapper 261.

Figure 4:
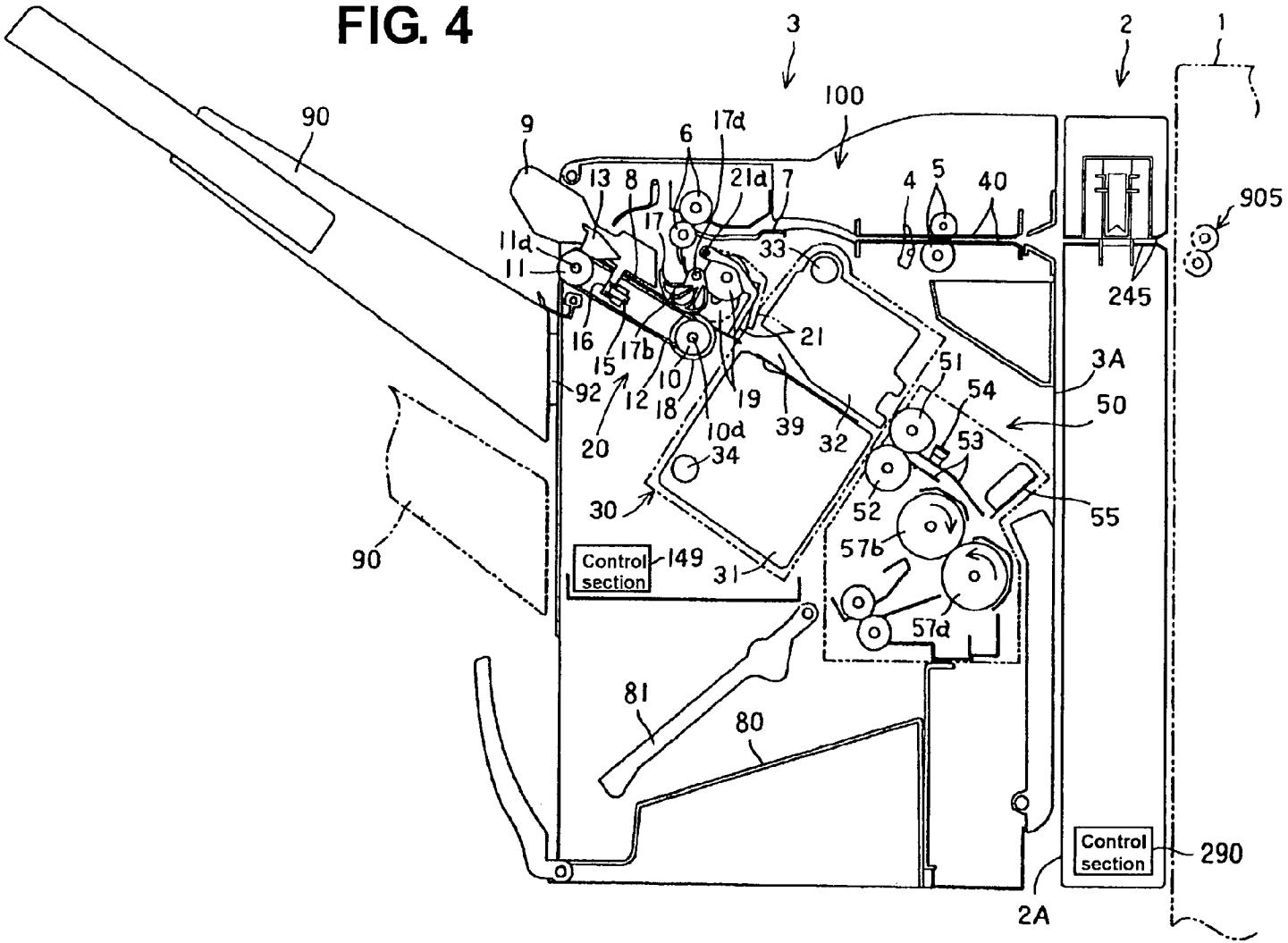
FIG. 4 is a side sectional view of a sheet post-processing apparatus and a sheet punching apparatus.

As shown in FIG. 4, the above components are accommodated in an apparatus frame 2A constituting a casing of the sheet punching apparatus 2. The sheet punching apparatus 2 has a control section 290 that controls the whole sheet punching apparatus 2. The control section 290 includes a CPU (hereinafter referred to as a CPU 2); a ROM that stores programs executed by the CPU 2 and program data; a RAM which functions as a work area for the CPU 2 and stores setting data received from the control section 950 of the digital copier main body 1A; and an interface used to communicate with the control section 950 of the digital copier main body 1A. In FIG. 4, the flapper 261, the garbage can 270, the motor 280, and other components shown in FIG. 3 are omitted.

<Sheet Post-Processing Apparatus>

As shown in FIG. 4, the sheet post-processing apparatus 3 has the following components in an apparatus frame 3A constituting a casing of the sheet post-processing apparatus 3: a conveying unit 100 that conveys a sheet discharged by the digital copier main body 1A via the sheet punching apparatus 2 in a substantially horizontal direction toward an area opposite to the discharge roller 905; an aligning unit 20 placed below the conveying unit 100 so as to extend obliquely for aligning ends of a plurality of sheets with images to form a sheet bundle; a stapler unit 30 placed at a downstream side of the aligning unit 20 so as to extend obliquely for binding the sheet bundle composed of the plurality of sheets; a folding unit 50 placed at a downstream side of the stapler unit 30 so as to extend obliquely for folding the sheet bundle at a predetermined position; a stack section in which the sheet bundle or a book (a sheet bundle subjected to the folding process) is stacked; and a control section 149 that controls the units of the sheet post-processing apparatus 3.

The conveying unit 100 has a conveying guide 40 that guides a sheet to the interior of the sheet post-processing apparatus 3; a loading guide 7 that guides the sheet further downstream; a pair of transfer rollers 5 disposed on the transfer guide 40 to nip and convey the sheet; a sheet sensor 4 that detects a leading end of the sheet transferred to the interior of the loading guide 40; and a pair of discharge rollers 6 disposed at a furthest downstream side in the loading guide to nip and discharge the sheet.

The aligning unit 20 has a processing tray 8 on which sheets discharged by the discharge roller pair 6 are stacked. The processing tray 8 is inclined at about 30 degrees relative to the platen glass 906 of the digital copier main body 1A so that its bottom corresponds to the sheet conveying direction. An aligning plate 9 is provided on the processing tray 8 to guide the opposite ends of the sheet and align it. An aligning motor (not shown) is disposed below the processing tray 8. A pinion 15 engaging a rack 16 is fitted around a motor shaft of the aligning motor. An elongate rectangular fixing member extends from the bottom of the aligning plate 9. A tip portion of the fixing member is fixed to the rack 16 through a slot formed in the processing tray 8 in a width direction. Accordingly, rotating the aligning motor enables the aligning plate 9 to move in the width direction of the processing tray 8 in accordance with the size of the sheet.

Below the center of the processing tray 8, pulleys 10 and 11 are fitted around pulley shafts 10*a* and 11*b*, respectively. An endless transfer belt 12 is extended between the pulleys 10 and 11. A conveying lower roller 18 is fitted around the pulley shaft 10*a*. An outer peripheral part of the conveying lower roller 18 is exposed from a top surface of the processing tray 8 via a notch formed in the processing tray 8. A driving force from a stepping motor (not shown; hereinafter simply referred to as a motor A) that can rotate forward and backward is transmitted to the pulley shaft 10*a*.

A conveying upper roller 19 is disposed above the conveying lower roller 18, and can move freely between an abutting position at which the conveying upper roller 19 abuts against the conveying lower roller 18 as shown by a phantom line and a separated position at which the conveying upper roller 19 is separated from the conveying lower roller 18 as shown by a solid line. Operations of the cam and the like move the conveying upper roller 19 between the abutting position and the separated position. The aligning motor (not shown) provides a rotating force to the conveying upper roller 19 via a gear.

A paddle 17 is placed below the loading guide 7 and above the processing tray 8, and rotates around a shaft 17*a* to urge a sheet in the sheet conveying direction. The paddle 17 is formed of an elastic member such as a rubber material with specific elasticity. The paddle 17 has a fin 17*b* formed radially around a shaft 17*a* and integrally with the shaft 17*a*. The paddle 17 is easily deformed when sheets are discharged and stacked on the processing tray 8 for providing an urging force that is appropriate for the conveyance in the sheet conveying direction.

A punching pawl 13 is secured to the endless transfer belt 12, and an end surface of the punching pawl 13 abuts against one side end of a sheet bundle stacked on the processing tray 8 to push the sheet bundle to an elevating and lowering tray 90. A home position (hereinafter simply referred to as an HP) is set for the pushing pawl 13. The HP is where the end surface of the pushing pawl 13 lies directly below the pulley shaft 10*a*. A detection arm and an arm detecting sensor are disposed below the endless transfer belt 12 to detect the HP of the pushing pawl 13. The detection arm engages the pushing pawl 13, and the arm detecting sensor is formed of a transmission type integral sensor.

A stopper 21 is placed above the processing tray 8 and near the stapler unit 30 to regulate and align one end of a sheet urged to fall along the obliquely installed processing tray 8 in the sheet conveying direction owing to its own weight and further urged by the rotation of the paddle 17. The stopper 21 has a generally J-shaped cross section having a led portion and an arm portion. One side of the arm portion of the stopper 21 is fixed to a solenoid plunger (not shown). The other side of the arm portion is pulled by a spring using a predetermined tensile force. The solenoid (not shown) is turned on and off to allow the stopper to move freely between a regulating position at which a bottom surface of the leg portion (the tip of the leg portion) abuts against the top surface of the processing tray 8 as shown by a solid line and a withdrawn position at which the stopper is withdrawn from the top surface of the processing tray 8 as shown by a phantom line. In this case, a support shaft located substantially in the center of the arm position is used as a support point.

The pushing pawl 13 can normally move to the elevating and lowering tray 90 (when the conveying upper roller 19 is in the separated position and the stopper 21 is in the withdrawn position). Accordingly, the pushing pawl 13 can be used to convey a sheet bundle with the one side end is aligned by the stopper at a regulating position to the elevating and lowering tray 90. Further, with the pushing pawl 13 located at the HP, the sheet bundle with its one side end aligned can be conveyed to the stapler unit 30 by being nipped between the conveying lower roller 18 and the conveying upper roller 19 in the abutting position.

The stapler unit 30 has a head assembly 31 placed at a downstream side of the aligning unit 20 and having a staple cartridge below a conveying passage 39 through which a sheet bundle is conveyed, and an anvil assembly 32 that receives and folds leg portions (tip portions) of staples driven out of the head assembly 31. The stapler unit 30 has a function for binding a sheet bundle at its end or center depending on the distance by which the sheet bundle is nipped and conveyed by the conveying lower roller 18 and the conveying upper roller 19. A binding process can be executed on the sheet bundle at one position at its end or at plural positions at its end or center via cylindrical guide rods 33 and 34 that support and guide the head assembly 31 and the anvil assembly 32 in a direction orthogonal to the sheet conveying direction. The stapler unit 30 is constructed as a unit shown by a phantom line. The stapler unit 30 can be withdrawn out of the sheet post-processing apparatus 3 so as to be replenished with staples.

The folding unit 50 is constructed at a downstream side of the stapler unit 30 as a unit shown by a phantom line. Similar to the stapler unit 30, the folding unit 50 can be withdrawn out of the sheet post-processing apparatus 3.

A bundle conveying upper roller 51 and a bundle conveying lower roller 52 are disposed at an inlet of the folding unit 50 to nip and transfer a sheet bundle toward a downstream side. A bundle conveying guide 53 is disposed at a downstream side of the bundle conveying upper roller 51 and bundle conveying lower roller 52 to guide the sheet bundle further toward a downstream side conveyed by the pair of the bundle conveying upper roller 51 and bundle conveying lower roller 52. A transmission-type integral end detecting sensor 54 is placed in a sheet bundle conveying path in the bundle conveying guide 53 to detect the leading end of the sheet bundle. The control section 149 contacts the bundle conveying upper roller 51 with the bundle conveying lower roller 52 on the basis of a sheet bundle tip detection signal from the end detecting sensor 54. The control section 149 also controls the setting of the folding position in the sheet bundle conveying direction.

The bundle conveying upper roller 51 is configured to be movable between a position at which it contacts the bundle conveying lower roller 52 and a position (not shown) at which it is separated from the bundle conveying lower roller 52. The bundle conveying upper roller 51 and the bundle conveying lower roller 52 are separated from each other until the end detecting sensor 54 detects the leading end of a sheet bundle. Once the end detecting sensor 54 detects the leading end of the sheet bundle, the bundle conveying upper roller 51 and the bundle conveying lower roller 52 are contacted with each other under pressure. Almost in synchronism with the start of the pressure contact, the conveying upper roller 19 shifts from the abutting position to the separated position. Then, the downstream conveyance of the sheet bundle shifts to the pressure contact conveyance between the bundle conveying upper roller 51 and the bundle conveying lower roller 52.

A roller pair is disposed below the conveying guide 53, and is formed of folding rollers 57*a* and 57*a* urged in a direction crossing the sheet bundle conveying direction so as to contact with each other under pressure, and rotationally driven in order to fold the sheet bundle. A knocking plate 55 is placed at a downstream side of the conveying guide 53 and in the direction crossing the sheet bundle conveying direction. A leading edge of the knocking plate 55 moves to the vicinity of a position at which the folding rollers 57*a* and 57*b* contact with each other under pressure to push the sheet bundle to this position.

When sheets are conveyed in the longitudinal direction, the folding unit 50 folds the sheet bundle at a distance from the tip portion (in the conveying direction) of the sheet bundle equal to a half of the length of the sheet bundle (that is, the center of the sheet bundle). A folded sheet bundle discharge stacker 80 is placed at a downstream side of the folding unit 50 and the bottom of the sheet post-processing apparatus 3, and has an inclined surface having an inclination opposite to that of the aligning unit 20, stapler unit 30, and folding unit 50. The sheet bundle folded by the folding unit 50 is stacked in the sheet bundle discharge stacker 80. A folded sheet presser 81 with one end rotationally movably fixed is placed above the folded sheet bundle discharge stacker 80 for folding and pressing the sheet bundle discharged with a combination of a falling force associated with the slope of the folded sheet bundle discharge stacker 80 and the urging force of a spring or the like.

An elevating and lowering tray 90 is placed on a side of the apparatus frame 2A which is opposite to the sheet punching apparatus 2, and can elevate and lower in a direction perpendicular to the apparatus frame 2A. The elevating and lowering tray 90 is supported by an elevating and lowering tray support section 92. The control section 149 includes a CPU (hereinafter referred to as a CPU 3); a ROM that stores programs executed by the CPU 3 and program data; a RAM which functions as a work area for the CPU 3 and stores setting data received from the control section 950 of the digital copier main body 1A; and an interface.

(Basic Principle)

The basic principle of the present invention will be specifically described below in order to show an operation of the digital copier 1. A brief description will also be given for the sections of the apparatus corresponding to the principle.

Figure 7A:
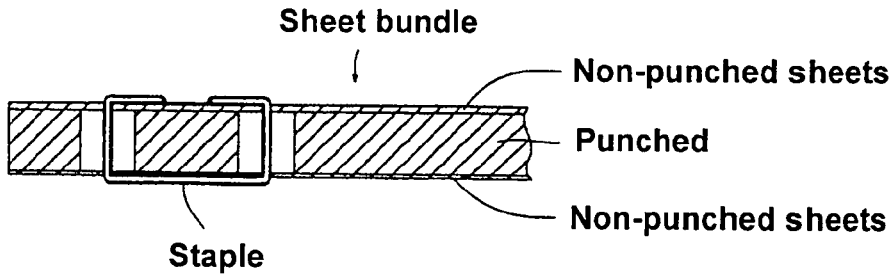
FIGS. 7(*a*) to 7(*c*) are side sectional views showing a punching position on a sheet bundle, wherein FIG. 7(*a*) schematically shows a sheet bundle with non-punched sheets, FIG. 7(*b*) schematically shows a sheet bundle without non-punched sheet, and FIG. 7(*c*) schematically shows that a staple penetrating the sheet bundle shown in FIG. 7(*b*) is bent using an anvil assembly.
Figure 7B:
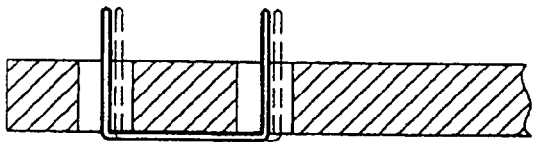
Figure 7C:
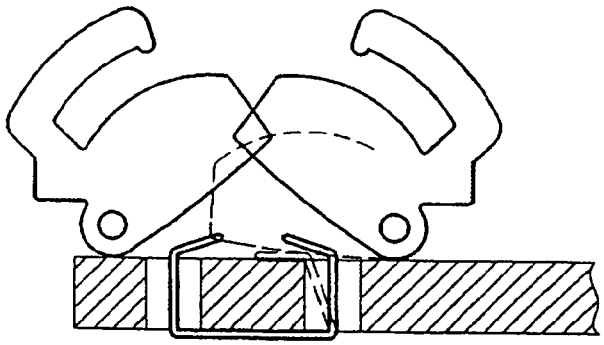

As shown in FIG. 7(*a*), the digital copier 1 according to the present embodiment uses staples to bind a sheet bundle formed of punched sheets and non-punched sheets placed above and below the punched sheets.

Figure 8:
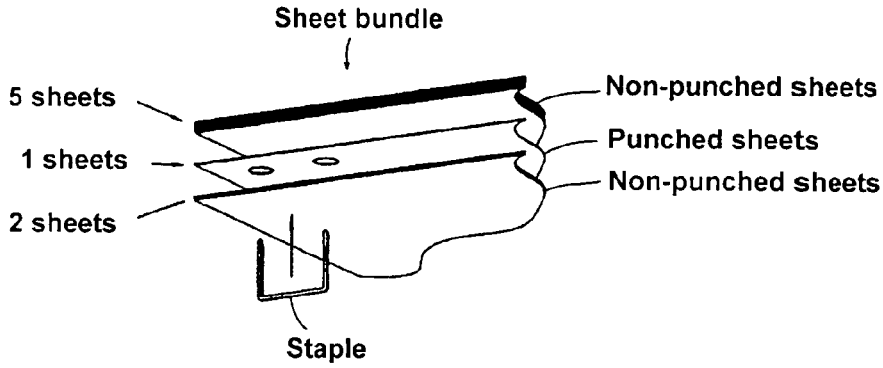
FIGS. 8(*a*) to 8(*c*) are views showing a relationship between non-punched sheets and punched sheets in a sheet bundle, wherein FIG. 8(*a*) shows a sheet bundle composed of eight sheets, FIG. 8(*b*) shows a sheet bundle composed of 50 sheets, and FIG. 8(*c*) shows a sheet bundle composed of seven sheets.

A load imposed on a staple for a sheet bundle composed of seven non-punched sheets as shown in FIG. 8(*c*) is the same as that for a sheet bundle composed of eight sheets (one punched sheet and seven non-punched sheets) as shown in FIG. 8(*a*) and a sheet bundle composed of 50 sheets (43 punched sheets and 7 non-punched sheets) as shown in FIG. 8(*b*). With a focus placed on this point, a sheet bundle is constructed using the mixture of punched and non-punched sheets.

Specifically, the image forming section 902 of the digital copier main body 1A forms images on sheets, and sequentially discharges the sheets with the images to the sheet punching apparatus 2. The sheet punching apparatus 2 selectively punches the sheets discharged by the digital copier main body 1A. Before the image forming section 902 forms images on the sheets, the control section 950 of the digital copier 1A determines whether the sheet punching apparatus 2 punches the image formed sheets in accordance with information obtained from the various switches (see FIG. 2) on the touch panel 248.

In accordance with this determination, for sheets not to be punched (non-punched sheets shown in FIG. 7(*a*)), the control section 290 of the sheet punching apparatus 2 does not execute a process of using the punches 250 to punch the sheets discharged by the digital copier main body 1A. The control section 290 then passes the sheets to the sheet post-processing apparatus 3 as they are. For sheets to be punched (punched sheets shown in FIG. 7(*a*)), the control section 290 of the sheet punching apparatus 2 uses the punches 250 to punch the sheets discharged by the digital copier main body 1A. The control section 290 then passes the sheets to the sheet post-processing apparatus 3.

In the sheet post-processing apparatus 3, the aligning unit 20 aligns the image formed sheets conveyed by the digital copier main body 1A via the sheet punching apparatus 2 to form a sheet bundle. The stapler unit 30 then uses staples to bind the sheet bundle at the punched positions on the punched sheets as bound positions. Before the image forming section 902 forms images on the sheets, the control section 950 of the digital copier 1A determines the punched positions in accordance with the information obtained from the various switches on the touch panel 248. In accordance with this determination, the control section 149 of the sheet post-processing apparatus 3 controls the stapler unit 30 and the like so that a binding process is executed at the bound positions using staplers.

(Operation)

<Operation of the Digital Copier Main Body>

The CPU 1 of the control section 950 uses the touch panel display operation control section 250 to allow the touch panel 248 to display an initial screen. At this point, the touch panel 248 (and a display screen of the personal computer 210) displays not only the above selection display switch button (see FIG. 2), but also a print mode selection switch button used to select a double side print mode in which images are formed on both surfaces of each sheet or a single side print mode in which an image is formed on one surface of each sheet; a sheet number specification button used to specify the number of sheet bundles having the same content and the number of sheets; a clear button used to clear a mode selected or the like; a start button used to cause the digital copier main body 1 to start image formation in the mode selected or the like; an indication of whether the digital copier 1A is in a standby state or a ready state (image formation is enabled); the number of sheets on which images have been formed; and the like. The operator sets the document D on the ADF 940, and then touches the touch panel 248 to change settings displayed on the touch panel 248 or input contents that have not been set yet. The operator then presses the start button on the touch panel 248. The CPU 1 loads all the settings (inputs or specifications) for the digital copier 1A transmitted by the touch panel control section 250, and executes an image forming routine to form images on sheets. Some or all of the settings on the touch panel 248 may be made using the personal computer 210.

Figure 6:
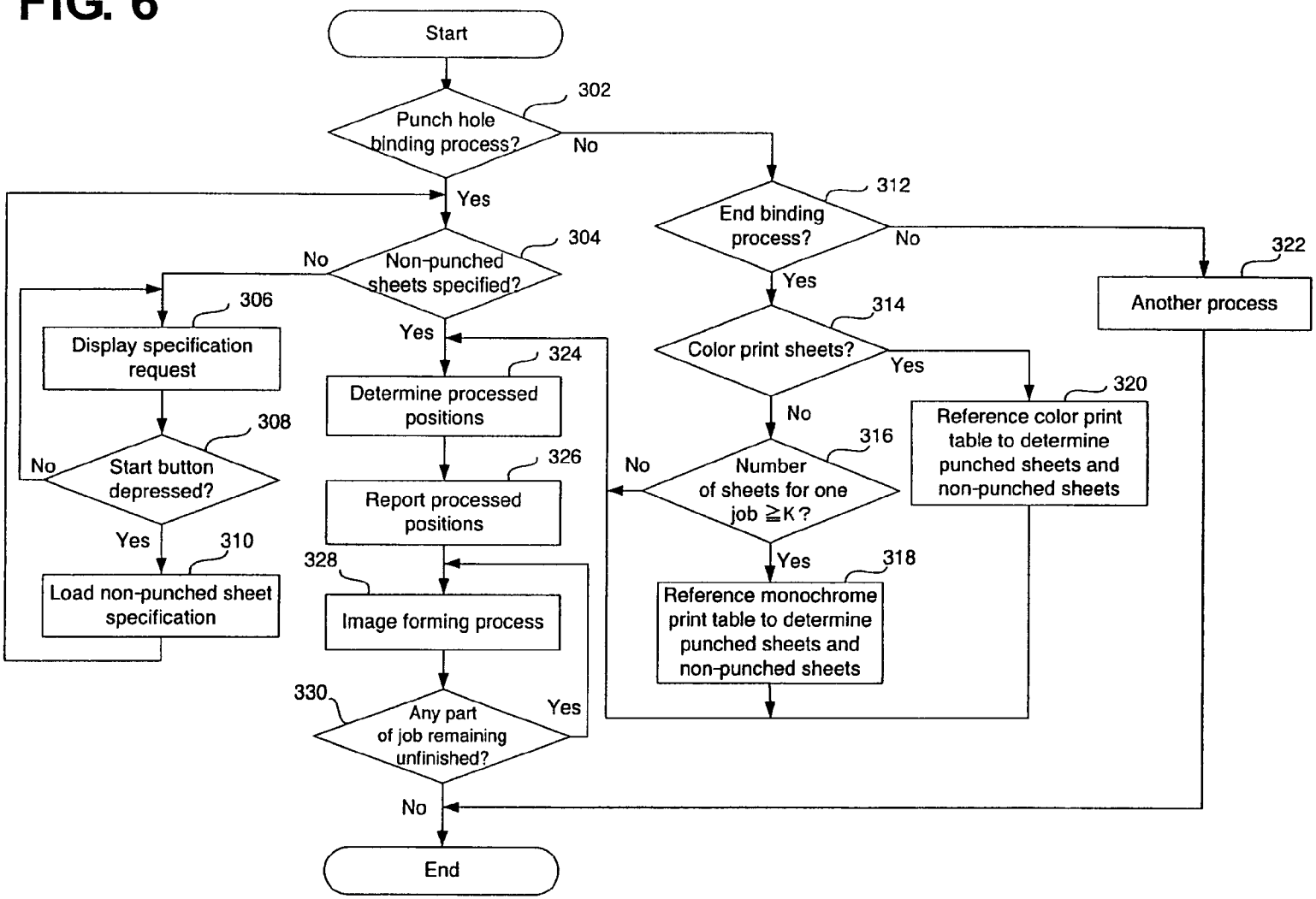
FIG. 6 is a flowchart of an image forming routine executed by a CPU of the control section of the digital copier main body.

As shown in FIG. 6, in the image forming routine, first, in step 302, the CPU 1 determines whether the punch hole binding process input switch button has been pressed to determine whether the punch hole binding process is to be performed. When the result of the determination is negative, the CPU 1 determines in step 312 whether an end binding process is to be executed, that is, the end binding process input switch button has been pressed. When the result of the determination is negative, another process such as a non-staple mode (described later) is selected in step 322. Accordingly, the CPU 1 carries out normal image formation (predetermined number of sheets) to finish the image forming routine. When the result of the determination is affirmative, the CPU 1 determines in step 314 whether the color print sheet button of the sheet type specification switches has been pressed.

When the result in step 314 is negative, monochrome sheets have been specified. Accordingly, in step 316, the CPU 1 determines whether the number of sheets for one job (the number of sheets constituting a sheet bundle) input using the image formed sheet number specification switch button exceeds the number of sheets K to be bound using the stapler unit 30. For example, when the stapler unit 30 is adapted to bind seven sheets, the number K of sheets to be bound is 7. When the number of sheets for one job input using the image formed sheet number specification switch button is below 7, the CPU 1 makes a negative determination. When the number of sheets for one job is more than 8, the CPU 1 makes an affirmative determination.

Specifically, when the CPU 1 makes a negative determination, the stapler unit 30 can successfully accomplish a binding process. When executing a binding process in accordance with information input using the image formed sheet number specification switch button, the stapler unit 30 can successfully bind the sheet bundle. When the CPU 1 makes a negative determination, the number of sheets for one job is beyond the binding process capability of the stapler unit 30. Consequently, when the stapler unit 30 executes a binding process in accordance with the information input using the image formed sheet number specification switch button, the sheet bundle may be inappropriately bound.

When the result of the determination in step 316 is negative, the CPU 1 proceeds to step 324. When the result of the determination in step 316 is affirmative, the CPU 1 references a monochrome print table to determine the numbers of punched sheets and non-punched sheets. The CPU 1 then proceeds to step 324. The processing in step 318 will be described in connection with the above example. When the stapler unit 30 is adapted to bind 7 sheets and the number of sheets input using the image formed sheet number specification switch button is 15, (the number of sheets constituting the sheet bundle: 15)−(the number of sheets to be bound using the stapler unit 30: 7)=(the number of punched sheets: 8) as shown in FIGS. 8(*a*) and 8(*b*). Accordingly, in the above example, in step 318, the CPU 1 references the table to determine that the number of non-punched sheets be 7 and the number of punched sheets is 8.

The CPU 1 also determines that 5 of the 7 non-punched sheets are located above the 8 punched sheets and include the last sheet penetrated by the leg portions of staples (the uppermost sheet of the sheet bundle shown in FIGS. 8(*a*) and 8(*b*)). The CPU 1 also determines that 2 of the 7 non-punched sheets are located below the 8 punched sheets and include the first sheet penetrated by the leg portions of the staples (the lowermost sheet of the sheet bundle shown in FIGS. 8(*a*) and 8(*b*)). The CPU 1 further determines the order of steps of punching the sheets constituting the sheet bundle. In the above example, the 5 non-punched sheets and the 2 non-punched sheets are located above and below the punched sheets. Such a setting can be changed using a switch button (not shown) on the touch panel 248. Further, in the present embodiment, the table is used, and equations or the like may be used.

When the result of the determination in step 314 is affirmative, the CPU 1 references a color print table to determine the numbers of punched and non-punched sheets, because color print sheets have coated surfaces and are thicker and stronger than monochrome sheets. The CPU 1 then proceeds to step 324. In general, for A4-sized sheets, 1,000 monochrome print sheets weigh about 55 kg, whereas 1,000 color print sheets weigh about 68 kg. The load imposed on the staplers is generally proportional to the weight of the sheets. Thus, this is reflected in the color print table according to the present embodiment.

Description will be given in connection with the above example. When the stapler unit 30 is adapted to bind 7 sheets and the number of sheets input using the image formed sheet number specification switch button is 15, the number of non-punched sheets is 7 and the number of punched sheets is 8 according to the monochrome print table. However, according to the color print table, the number of non-punched sheets is 6 and the number of punched sheets is 9. The CPU 1 determines that 4 of the 6 non-punched sheets be located above the 9 punched sheets and include the last sheet penetrated by the leg portions of the staples. The CPU 1 also determines that 2 of the 6 non-punched sheets be located below the 9 punched sheets and include the first sheet penetrated by the leg portions of the staples.

When the result of the determination in step 302 is affirmative, the CPU 1 determines in step 304 whether the non-punched sheets have been specified, that is, whether the non-punched sheets have been specified using the non-punched sheet specification switch button. Specifically, in the above example, the CPU 1 determines, for the monochrome print sheets, whether one or both of the 5 non-punched sheets located above the 8 punched sheets and the 2 non-punched sheets located below the 8 punched sheets. The CPU 1 determines, for the color print sheets, whether one or both of the 4 non-punched sheets located above the 9 punched sheets and the 2 non-punched sheets located below the 9 punched sheets. Accordingly, in steps 316 and 320, the CPU 1 automatically selects sheets to be punched in accordance with the table.

In step 304, the CPU 1 prompts the operator to manually input data on the sheets to be punched. In order to allow the operator to easily input specifications for the non-punched sheets, the CPU 1 according to the present embodiment causes the touch panel to display the punched sheets and non-punched sheets in accordance with the information input using the image formed sheet number specification switch button to assist the operator in inputting the data.

When the result in step 304 is affirmative, the CPU 1 proceeds to step 324. When the result of the determination in step 304 is negative, the CPU 1 causes the touch panel 248 to display a request for the specification of non-punched sheets in step 306. The CPU 1 then waits in step 308. When the start button is pressed, the CPU 1 loads specifications input using the non-punched sheet specification switch button in step 310. To allow for the case in which the start button is pressed with no specifications input using the non-punched sheet specification switch button (the specifications input using the non-punched sheet specification switch button is null), the image forming routine returns to step 304.

In step 324, depending on whether the end binding process input switch button or the center binding process input switch button has been pressed as well as a sheet size specified using the sheet size specification switch, the CPU 1 determines punched positions on the sheets when the punching process input switch button has been pressed. The CPU 1 determines the punched positions on the sheets and positions at which the sheet bundle is bound using staples when the punch hole binding process input switch button has been pressed. That is, for example, a stored table indicates, for each sheet size, the positions at which the sheet bundle is bound using staples for an end binding process and a center binding process. The CPU 1 references the table to determine the bound positions. As shown in FIG. 7(*a*), in the present embodiment, a binding process with a staple is executed at a position midway between punch holes formed in the sheets. Consequently, provided that the punched positions on the sheets are determined, the bound positions on the sheets need not be determined.

In step 326, through communications, the CPU 1 reports information on the control of the sheet punching apparatus 2 and the sheet post-processing apparatus 2 including the bound positions and the sheet size, to the control section 290 of the sheet punching apparatus 2 and the control section 149 of the sheet post-processing apparatus 3. In this reporting form, the bound positions (for example, the actual distance from the sheet end) and the like need not be reported as they are. Instead, it is possible to use default values that can be recognized by all the control sections 950, 290, and 149. To allow the use of default values that can be recognized by all the control sections 950, 290, and 149, it is possible to, for example, store default values from a common table in the ROM. Alternatively, during an initial setting process executed when the sheet post-processing apparatus 2 is powered on, the control section 149 notifies the control sections 950 and 290 of contents of the default values.

In step 328, the digital copier main body 1A forms images on sheets. Specifically, when the control section 950 outputs a sheet feeding signal, a motor (not shown) exerts power to feed sheets in one of the cassettes 910, 911, and 913, corresponding to the sheet size specified to the image forming section 902. A pair of resist rollers in the sheet feeding section 909 corrects the sheets for skews and also adjusts a timing for the sheets. The sheets are then conveyed to the image forming section 902. The CPU 1 causes the image input section 200 to read the document D. The CPU 1 then causes the laser unit 922 to irradiate the photosensitive drum 914 with each line of read image data for one sheet. The photosensitive drum 914 is charged using the primary charger 919. The light applied forms an electrostatic latent image on the photosensitive drum 914. The developing member 915 develops the electrostatic latent image to form a toner image on the photosensitive drum 914.

In the image forming section 902, the transfer charger 916 transfers the toner image on the photosensitive drum 914 to a sheet fed. The separating charger 917 charges the sheet having the toner image with a polarity opposite to that provided using the transfer charger 916. The sheet is thus separated from the photosensitive drum 914. The endless conveying belt 920 further conveys the sheet separated to the fixer 904. The fixer 904 then permanently fixes the transferred image to the sheet to form an image on the sheet. The discharge roller pair 905 discharges (conveys) the sheet from the digital copier main body 1A to the sheet punching apparatus 2.

In step 330, the CPU 1 determines whether any part of the job remains unfinished. When the result of the determination is affirmative, the CPU 1 returns to step 328 to process the remaining part of the job. When the result of the determination is negative, the CPU 1 finishes the image forming routine. When the double side printing is specified, an image is also formed on the other side of the sheet via the duplex 921. The sheet is then discharged to the sheet punching apparatus 2.

<Operation of the Sheet Punching Apparatus>

Upon receiving the report from the CPU 1 in step 326, the CPU 2 rotates the motor 280 in accordance with the information of end binding (one or two positions) or center binding received from the CPU 1. Specifically, for end binding at two positions and center binding, two holes are punched out of the sheet. For end binding at one position, one hole is punched out of the sheet. For the end binding at two positions and center binding, the motor 280 is rotated forward to move the slide holder 201 in the direction of arrow A in FIG. 3. For the end binding at one position, the motor 280 is rotated backward (CCW) to move the slide holder 201 in the direction of arrow B in FIG. 3.

During the initial setting following power-on, the CPU 2 uses the detection sensor 291 to determine whether the RP detection piece 285A has been detected. When the result of the determination is negative, the CPU 2 operates the motor 280 until the detection sensor 291 detects the RP detection piece 285. Thus, during the initial setting, the slide holder 201 is placed at the reference position.

Figure 5:
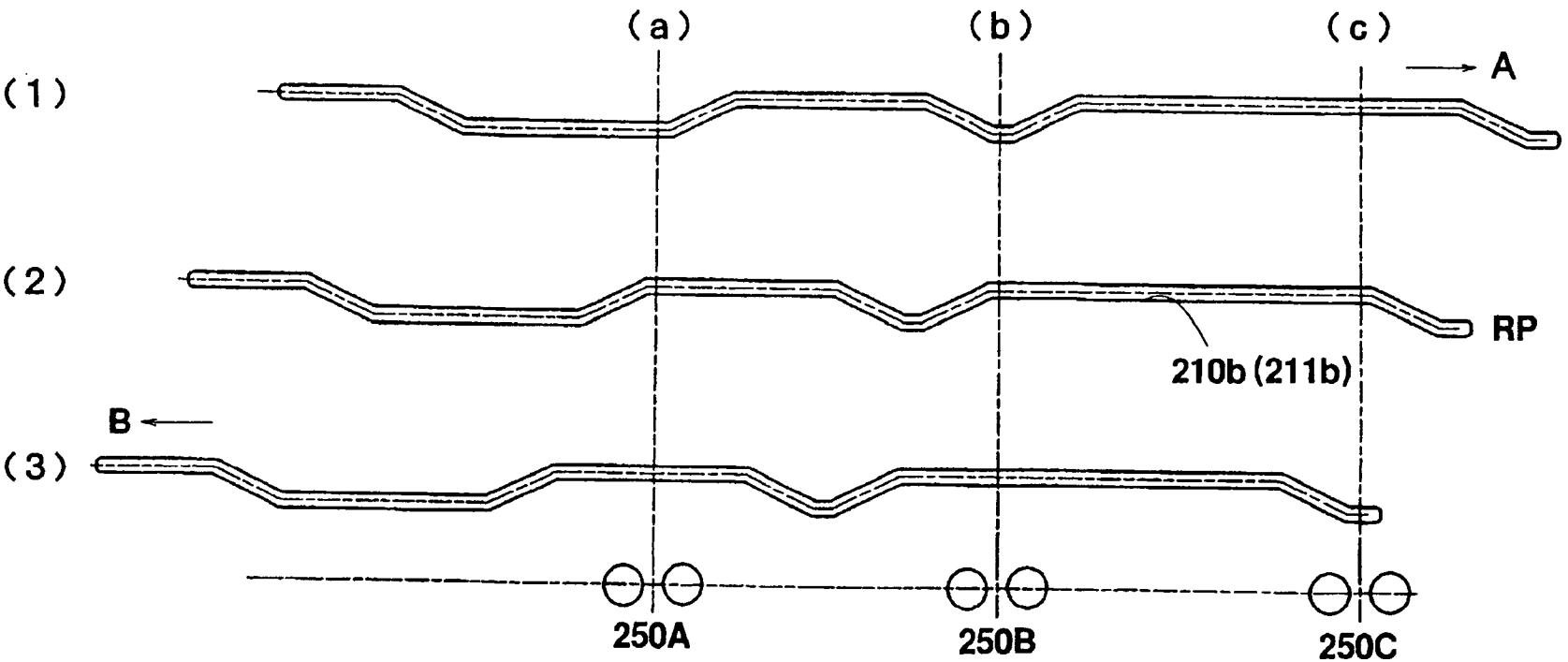
FIG. 5 is a diagram schematically illustrating a positional relationship between a punch and a guide groove formed in a slider of the sheet punching apparatus.

With reference to FIG. 5, a detailed description of the relationship between the punches 250 and the guide grooves 210*b* and 211*b* will be given. As described above, the sliders 210 and 211 are fixed to the slide guide 201. Accordingly, when the slide guide 201 is located at its reference position, the guide grooves 210*b* and 211*b* are also located at their RPs. As shown in FIG. 5, (2) conceptually shows the guide groove 210*b* (211*b*) in this state.

The three punches 250 are denoted as 250A, 250B, and 250C, and the operating pins 251 are denoted as 251A, 251B, and 251C, in an order from the motor 280 shown in FIG. 3. The punch 250A at its RP is located a position (2)(*a*) in FIG. 5. The punch 250B is located a position (2)(*b*) in FIG. 5. The punch 250C is located a position (2)(*c*) in FIG. 5. In other words, the operating pin 251A engages the guide groove 210*b* (211*b*) located at the RP in the position (2)(*a*). The operating pin 251B engages the guide groove 210*b* (211*b*) located at its RP in the position (2)(*b*). The operating pin 251C engages the guide groove 210*b* (211*b*) located at its RP in the position (2)(*c*).

It should be noted that at the RP, the operating pins 251A to 251C engage the guide groove 210*b* (211*b*) in the upper horizontal groove portion described above. Thus, punching blades of the punches 250A to 250C are located at their withdrawn positions above the channel bottom portion 22 of the upper punch guide 220. If the punching process is not set, the sheet can be conveyed to the sheet post-processing apparatus 3 as it is. In this case, the CPU 1 does not stop the sheet conveyance as described above, and conveys the sheet to the sheet post-processing apparatus 3 via the sheet punching apparatus 2.

The motor 280 is rotated forward by a predetermined number of steps to move the slide holder 201 in the direction of arrow A in FIG. 3. Since the slider 210 (211) is fixed to the slide holder 201, the guide groove 210*b* (211*b*) formed in the slider 210 (211) slides from its RP by a predetermined distance in the direction of arrow A. The operating pins 251A to 251C have a small allowance and are regulated by the pin penetrating window 221*a* (222*a*). The operating pins 251A to 251C thus do not move in the direction of arrow A as the guide groove 210*b* (211*b*) slides. Consequently, the operating pin 251A moves from the upper horizontal groove portion via the inclined groove portion to a position (1)(*a*) in the lower horizontal groove portion. The operating pin 251B moves from the upper horizontal groove portion via the inclined groove portion to a position (1)(*b*) in the lower horizontal groove portion. The operating pin 251C slides through the upper horizontal groove portion to a position (1)(*c*).

In other words, the operating pins 251A and 251B are gradually guided through the inclined groove portion to the punched positions in the lower horizontal groove portion. The punching blades of the punches 250A and 250B penetrate the through-hole formed in the channel bottom portion 223 and the through-hole 231*a* formed in the central planar portion 231, respectively. As a result, holes are punched out of the sheets. Since the operating pins 251A and 251B slide through the upper horizontal groove, the punches 251A and 251B are held at their withdrawn positions.

In the present embodiment, the slider 210 (211) is formed with the guide groove 210*b* (211*b*) formed of the three groove portions connected together and including the upper horizontal groove portion, the lower inclined groove portion, and the inclined groove portion. Accordingly, it is possible to select combinations with which the punches 250 are used to punch one or two holes out of the sheets. Of the three groove portions, the upper horizontal groove portion functions as a withdrawing section that stops (holds) the punches 250 at their withdrawn positions. The inclined groove portion functions as an advancing section that advances the punches to their punching positions. Furthermore, the inclined groove portion has a function for exerting a downward pressing force on the punches 250 by engaging with the operating pins 251. The lower horizontal groove portion function as a limit for the punches advanced to the lowermost end of the punching position. Further, the operating pins 251 engage the guide groove 210*b* (211*b*), so that the slider 210 (211) supports the three punches and the punches are freely movable between their withdrawn positions and punching positions.

After the CPU 2 rotates the motor 280 forward or backward to punch one or two holes out of the sheets, the CPU 2 rotates the motor 280 backward or forward by a predetermined number of steps to determine whether the detection sensor 291 has detected the RP detection piece 285A. When the result of the determination is affirmative, the CPU 2 stops the motor 280. When the result of the determination is negative, the CPU 2 rotates the motor 280 backward or forward until the detection sensor 291 detects the RP detection piece 285A. The CPU 2 then stops the motor 280 and notifies the CPU 1 that the motor 280 has been stopped. That is, the motor 280 is rotated backward or forward by the predetermined number of steps to place the guide groove 210*b* (211*b*) in the slider 210 (211) at its RP. The punches 250 advanced to their punching positions are placed at their withdrawn positions. Thus, the sheets can pass through the loading space without being obstructed by the punches 250 advanced into the loading space.

Upon being notified by the CPU 2, the CPU 1 rotates the discharge roller pair 905. When a sensor (not shown) located at a downstream side of the discharge roller pair 905 detects the trailing end of the sheets, the CPU 1 stops rotating the discharge rollers 905. Thus, the sheets are conveyed to the sheet post-processing apparatus 3. In contrast, for non-punched sheets, the CPU 1 conveys the image formed sheets to the sheet post-processing apparatus 3 via the sheet punching apparatus 2 without stopping the discharge roller pair 905, in accordance with the determinations in steps 318 and 320 or the information input through the non-punched sheet specification switch button (that is, the CPU 1 determines the sheets to be of the non-punched type).

<Operation of the Sheet Post-processing Apparatus>

Upon being notified by the CPU 1, the CPU 2 moves the head assembly 31 and the anvil assembly 32 to their initial positions. The CPU 2 then waits for sheets to be discharged by the digital copier main body 1A via the sheet punching apparatus 2. An operation of the sheet post-processing apparatus 3 in each mode will be described next.

(1) Non-Binding Mode

The sheet post-processing apparatus 2 executes the non-binding mode when none of the buttons including the end binding process input switch button is pressed. The CPU 3 drives the motor A to move the endless transfer belt 12 to move the pushing pawl 13 to a pre-home position (Pre-HP) at which the pushing pawl 13 acts as a sheet stacking reference on the processing tray 8 and the end surface of the pushing pawl 13 is placed at a position closer to the elevating and lowering tray 90 than a position immediately above the pulley shaft 10. The pushing pawl 13 is then stopped. At this time, the conveying upper roller 19 is at its separated position, while the stopper 21 is at its withdrawn position. The movement from HP to Pre-HP is accomplished by counting the number of pulses transmitted to the motor A.

Concurrently, the CPU 3 rotates the driving rollers of the conveying roller pair 5 and discharge roller pair 6, and waits for sheets to be conveyed by the digital copier main body 1A. Once the sheets have been discharged, the CPU 3 uses the conveying roller pair 5 and the discharge roller pair 6 to convey the sheets to the processing tray 8. When the sheet sensor 4 detects the sheets, the CPU 3 adjusts timings for actuating the aligning motor, which moves the aligning plate 9, and the paddle motor, which rotates the paddle 17.

Once the sheets have been discharged to the processing tray 8, the CPU 3 drives the aligning motor and the paddle motor. The driving moves the aligning plate 9 in a width direction crossing the sheet conveying direction to align the opposite ends of the sheets. The paddle 17 rotates to align the end of the sheets with the end surface of the pushing pawl 13 located at the Pre-HP. This operation is repeated every time a sheet is discharged to the processing tray 8.

Once a predetermined number of sheets have been aligned with the end surface of the pushing pawl 13, the CPU 3 stops the conveying motor and the paddle motor. The CPU 3 also drives the motor A to cause the end surface of the pushing pawl 13 to push and move the sheet bundle to the elevating and lowering tray 90. This allows the sheet bundle to be stacked on the elevating and lowering tray. Once the sheet bundle has been stacked on the elevating and lowering tray 90, the CPU 3 rotates an elevating and lowering tray motor (not shown) to lower by a specified amount. The CPU 3 rotates the elevating and lowering tray motor backward to elevate the elevating and lowering tray 90. The CPU 3 causes the elevating and lowering tray 90 to wait for the next sheet bundle to be loaded.

In the non-binding process mode, which does not require the binding process, the CPU 3 positions the pushing pawl 13 at its Pre-HP in advance, stacks a sheet bundle, and then pushes it to the elevating and lowering tray 90 without transferring the sheets to the regulating position of the stopper 21. Therefore, even if the digital copier main body 1A discharges sheets at a high speed as in a case where the sheets are not punched, the sheet post-processing apparatus 3 can follow the discharge speed.

(2) End Binding Process Mode

The sheet post-processing apparatus 2 executes the end binding process when the end binding process input switch button, shown in FIG. 2, is pressed. The CPU 3 places the stopper 21 at its regulating position while a solenoid (not shown) is on. The CPU 3 rotates the driving rollers of the conveying roller pair 5 and discharge roller pair 6 to discharge sheets discharged by the digital copier main body 1A to the processing tray 8. The CPU 3 then drives the aligning motor and the paddle motor. The aligning plate 9 aligns the opposite ends of the sheets in the width direction. The end of the sheets is transferred to the sides of the leg portions of the stoppers 21 before the sheets are stopped. This operation is repeated for the particular number of sheets input using the image formed sheet number specification switch button. As a result, the sheet bundle is regulated and aligned by the stopper 21.

After the sheet bundle is aligned with the stopper 21, the CPU 3 moves the conveying upper roller 19 to the conveying lower roller 18, where the sheet bundle is nipped (sandwiched). The CPU 3 then turns off the solenoid (not shown) to place the stopper 21 at its withdrawn position. The CPU 3 then drives the motor A by a predetermined number of steps in a direction opposite to that used in the non-binding process mode. The driving causes the conveying upper roller 19 and the conveying lower roller 18 transfers the sheet bundle sandwiched between the rollers 19 and 18 to the stapler unit 30, so that the head assembly 31 is located at its head position where the sheet bundle is to be bound at its initial position.

When the motor A is rotated backward as described above, a one-way clutch (not shown) is interposed between the pulley 10, around which the endless transfer belt 12 is extended, and the pulley shaft 10*a*. A driving force from the motor A is not transmitted to the endless transfer belt 12. The endless transfer belt 12 and the pushing pawl 13 remain stopped. Then, in accordance with the information determined by the CPU 1 in step 324 and received in step 326, the CPU 3 uses the head assembly 31 and the anvil assembly 32 as well as staples to bind the sheet bundle at the punched positions at the end of the sheets as bound positions. When the sheet bundle is bound at a plurality of positions at its end (two holes have been punched out of the sheets), the binding process is executed after the stapler unit 30 has been moved.

Once the binding process has been completed, the CPU 3 causes the motor A to drive the conveying lower roller 18, the conveying upper roller 19, and the endless transfer belt 12 so as to convey the sheet bundle to the elevating and lowering tray 60. The driving causes the sheet bundle to be delivered from the conveying lower roller 18 and the conveying upper roller 19 to the pushing pawl 13. The pushing pawl 13 pushes the sheet bundle to the elevating and lowering tray 90. The sheet bundle is thus stacked on the elevating and lowering tray 90. The subsequent operation of the elevating and lowering tray 90 is the same as that executed in the non-blinding mode described above. Accordingly, its description is omitted.

(3) Center Binding Process Mode

The sheet post-processing apparatus 2 executes the center binding process mode when the center binding process input switch button and folding process input switch button, shown in FIG. 2, are pressed. As in the case of the end binding process mode, the CPU 3 stacks sheets discharged by the digital copier main body 1A on the processing tray 8. Once the sheet bundle has been aligned and stacked on the processing tray 8, the CPU 3 lowers the conveying upper roller 19 to the conveying lower roller 18 to sandwich the sheet bundle between the rollers 19 and 18. The CPU 3 turns off the solenoid (not shown) to place the stopper 21 at its withdrawn position. Then, the CPU 3 drives the motor A in a direction opposite to that used in the non-binding process mode to convey the sheet bundle sandwiched between the conveying upper roller 19 and the conveying lower roller 18 to the stapler unit 30.

After the transfer of the sheet bundle has been started, the end detecting sensor 54 detects the leading end of the sheet bundle in the conveying direction. On the basis of the sheet length contained in the information received from the CPU 1 in step 326, the CPU 3 conveys the sheet bundle to a position where the center of the sheets in the conveying direction coincides with the bound positions. The CPU 3 then stops the driving of motor A and binds the sheet bundle at its center in the conveying direction.

Subsequently, for a folding process, the CPU 3 places the conveying upper roller 19 at its separated position and releases the sheet bundle sandwiched between the rollers. The CPU 3 drives the conveying motor 162 to rotate the bundle conveying upper roller 51 and the bundle conveying lower roller 52. The sheet bundle is thus conveyed further toward a downstream side. During this conveyance, on the basis of the detection signal from the end detecting sensor 54 and the sheet length information stored in the RAM, the CPU 3 reduces the speed at which the sheet bundle is conveyed until it is stopped, so that the sheet bundle is folded at its center in the conveying direction, that is, the bound positions.

Then, the CPU 3 rotates the folding rollers 57*a* and 57*b* in the direction in which the sheet bundle is nipped between the rollers 57*a* and 57*b*. At the same time, the CPU 3 lowers the knocking plate 55. Once the knocking plate 55 has lowered, the sheet bundle is caught between the folding rollers 57*a* and 57*b*. Subsequently, the knocking plate 55 moves away from the sheet bundle. The folding rollers 57*a* and 57*b* further fold the sheet bundle (conveys the sheet bundle nipped between the rollers). The sheet bundle (book) conveyed while being nipped between the folding rollers 57*a* and 57*b* is discharged to the folded sheet bundle discharge stacker 80. The sheet bundle is stacked on the folded sheet bundle discharge stacker 80.

After the folding operation has been started, a knocking plate HP sensor (not shown) detects that the knocking plate 55 has reciprocated a predetermined number of times depending on the length of the sheet bundle in the conveying direction. Then, the CPU 3 stops the operation of each section of the folding unit 50.

(Effects)

Now, description will be given of, for example, the effects of the digital copier 1 according to the present embodiment.

With the digital copier 1 according to the present embodiment, as shown in FIGS. 8(*a*) and 8(*b*), the stapler unit 30 uses staples to bind a sheet bundle at the punching positions on image formed sheets punched using the punches 250 as the bound positions. Accordingly, it is unnecessary to penetrate the staples all the sheets constituting the sheet bundle as in a case of conventional stapler units. This allows the sheet bundle to be bound without increasing a size of the apparatus, noise, vibration, or power consumption. Further, even if the stapler unit 30 has a low binding process capability (for example, the stapler unit 30 is adapted to bind 7 sheets in the above example), it can execute a binding process equivalent to that achieved by a stapler unit having a high binding process capability (for example, one adapted to bind 50 sheets). This allows a reduction in the cost and size of the sheet punching apparatus 2 and thus of the digital copier 1.

Figure 8B:
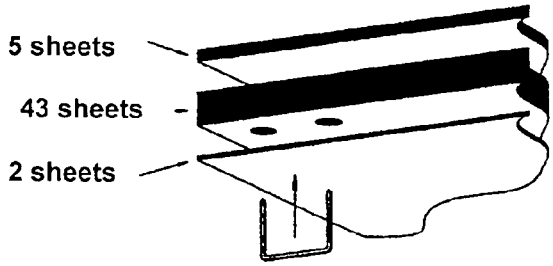
Figure 8C:
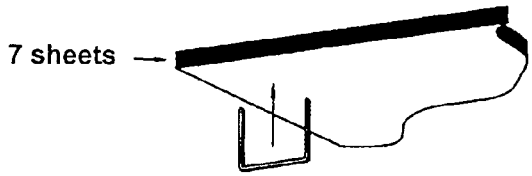

Further, with the digital copier 1 according to the present invention, the aligning unit 20 forms the sheet bundle having the non-punched sheets on both sides of the punched sheets as shown in FIGS. 7(A), 8(A), and 8(B). Consequently, after the staples have been driven into and penetrated the non-punched sheets (sheet bundle), the sheet bundle can be reliably bound without a positional deviation from the anvil assembly 32.

When the sheet bundle is composed of only punched sheets and does not include any non-bound sheets, the staples are not firmly positioned in the punch holes in the punched sheets (staples move freely) as shown in FIG. 7(*b*). Then, as shown by the phantom line in FIG. 7(*c*), when the anvil assembly 32 folds the tips of the staples, a folding error may occur. As a result, the sheet bundle can not be reliably bound. The staples according to the present embodiment may have an appropriate strength even if, for example, the sheet bundle is composed of 50 sheets. Therefore, the digital copier 1 has an advantage in that the sheet bundle can be easily unbound.

Moreover, with the digital copier 1 according to the present invention, the aligning unit 20 forms the sheet bundle having the non-punched sheets arranged above the punched sheets as shown in FIG. 7(*a*). Consequently, even if the staples move within the punched positions on the sheets of the sheet bundle, it is possible to prevent the sheets from coming off sequentially or all together from the bent leg portions (tip portions) of the staples and then loosening. Further, the non-punched sheets are arranged below the punched sheets, so that the punch holes formed in the punched sheets are hidden. Therefore, regardless of whether the characters in the document are written horizontally or vertically, the sheet bundle has a good appearance equivalent to that of a sheet bundle formed according to the prior art.

In the example shown in the present embodiment, for simplification, the bound positions are uniformly determined in accordance with the table on the basis of the sheet size and the contents of the binding process. However, the copier may comprise an adjustment function for allowing the operator to change the bound positions. Such an adjustment function makes it possible to deal with the case where an image is formed at a bound position.

Further, in the present embodiment, the digital copier 1 has the hard disk 961. Accordingly, the image data stored in the hard disk may be utilized. Specifically, the hard disk 961 may already store the image data transmitted by the personal computer 210 to the hard disk 961 or previously obtained by the image input section 200 by reading the document D. When the personal computer 210 transmits image data to the hard disk 961, the CPU determines an ID for a folder in which all the image data are stored, and the ID can be input using ten keys or the like. The CPU further provides the ID to the folder as its name.

In the latter case, the CPU uses the touch panel display operation control section 250 to cause the touch panel to display a message asking the operator whether to store the image data as they are or delete them. When the operator desires to store the image data as they are, the CPU prompts the operator to input the ID for the folder in which all the image data are stored, and the ID can be input using ten keys or the like. Accordingly, when the ID is input from the touch panel 210 or via the computer 210, the CPU checks whether the image data is stored in the folder corresponding to the ID input. The CPU thus determines whether the image has been stored. When the result of the determination is affirmative, the CPU reads the image data stored in the folder. When the result of the determination is negative, the CPU uses the automatic document feeding apparatus 940 or the like to read the image from the document D. Thus, utilizing the image data stored in the hard disk 961 eliminates the need to read the document D every time when a large number of sheet bundles are to be created. This is effective in terms of time and labor.

Moreover, in the example shown in the present embodiment, the sheet bundle is formed by placing and stacking the sheets on the aligning unit 20. The present invention is not limited to this. For example, the aligning unit may form the sheet bundle by standing sheets so that they are aligned with one another.

In the example shown in the present embodiment, the head assembly 31 and anvil assembly 32 constituting the stapler unit 30 are moved relative to the sheet bundle. Alternatively, the sheet bundle may be moved, or both sheet bundle and stapler unit 30 may be moved. In this aspect, to move both of them, it is possible to reduce the time for which the stapler unit 30 is placed at the bound positions.

In the example shown in the present embodiment, the control section 950 of the digital copier main body 1A determines the punched positions or the like in step 324. However, the present invention is not limited to this. The control section 290 of the sheet punching apparatus 2 may determine the punched positions and notify the control section 149 of the sheet post-processing apparatus 3 of the bound positions. Alternatively, the control section 149 of the sheet post-processing apparatus 3 may determine the bound positions and notify the control section 290 of the sheet punching apparatus 2 of the punched positions.

Further, in the example of the present embodiment, in the punch hole binding process, the specification for the non-punched sheets made by the operator is loaded as it is. The punching process is then executed as specified by the operator. The following operation may be performed instead. The CPU determines whether the number of the sheets for one job exceeds the number of the sheets to be bound by the stapler. If the former exceeds the latter or only sheets different from monochrome ones such as color print sheets are specified, a request for the specification is displayed in step 306. Moreover, in the example shown in the present embodiment, the non-punched sheets are specified using the non-punched sheet specification switch button, and the punched sheets may be specified.

In the present embodiment, color print sheets are illustrated as a typical sheet type specification switch button, and a plurality of sheet type specification switch buttons may be provided in association with a thickness of a sheet or indirectly, for example, in accordance with, for example, the weight of the sheets in kg.

The disclosure of Japanese Patent Application No. 2003-429547, filed on Dec. 25, 2003, is incorporated in the application.

While the invention has been explained with reference to the specific embodiments of the invention, the explanation is illustrative and the invention is limited only by the appended claims.

What is claimed is:

1. An image forming apparatus comprising:

an image forming device for forming an image on a sheet, a conveying device for conveying the sheet with the image formed by the image forming device, a punching device for punching the sheet conveyed by the conveying device at a punching position, a punching process determining device for determining whether the punching device punches the sheet with the image formed by the image forming device, a sheet bundle forming device for forming a sheet bundle of the sheet punched by the punching device and a sheet not punched by the punching device, and a binding device for driving a staple into the sheet bundle at the punching position as a bound position to bind the sheet bundle.

2. An image forming apparatus according to claim 1, wherein said punching process determining device controls the punching device not to punch at least a last sheet of the sheet bundle at the bound position penetrated by leg portions of the staple driven by the binding device.

3. An image forming apparatus according to claim 1, wherein said punching process determining device controls the punching device not to punch at least a first sheet of the sheet bundle at the bound position penetrated by leg portions of the staple driven by the binding device.

4. An image forming apparatus according to claim 1, further comprising a binding process specifying device for specifying a binding process executed by the binding device, and a sheet number setting device for setting a number of the sheets on which the images are to be formed, said punching process determining device determining whether the punching device punches the sheet with the image formed by the image forming device according to the number of the sheets set by the sheet number setting device when the binding process specifying device specifies the binding process.

5. An image forming apparatus according to claim 4, wherein said punching process determining device determines whether the punching device punches the sheet with the image formed by the image forming device when the number of the sheets set by the sheet number setting device exceeds a predetermined number of the sheets bound by the binding device.

6. An image forming apparatus according to claim 4, further comprising a selecting device for allowing an operator to select whether the punching device punches the sheet with the image formed by the image forming device, said punching process determining device determining whether the punching device punches the sheet according to a selection made by the operator using the selecting device when the number of the sheets specified by the sheet number setting device exceeds a predetermined number of the sheets bound by the binding device.

7. An image forming apparatus according to claim 1, further comprising a binding process specifying device for specifying a binding process executed by the binding device, and a type specifying device for specifying a type of the sheets on which the images are to be formed, said punching process determining device determining whether the punching device punches the sheet with the image formed by the image forming device according to the type of the sheets specified by the type specifying device when the binding process specifying device specifies the binding process.

8. An image forming apparatus according to claim 7, wherein said punching process determining device determines whether the punching device punches the sheet with the image formed by the image forming device when the type specifying device specifies a sheet for color print as the type of the sheet.

9. An image forming apparatus according to claim 7, further comprising a selecting device for allowing an operator to select whether the punching device punches the sheet with the image formed by the image forming device, said punching process determining device determining whether the punching device punches the sheet according to a selection made by the operator using the selecting device when the type specifying device specifies a sheet for color print as the type of the sheet.

* * * * *